US006945745B2

(12) United States Patent
Retzlaff

(10) Patent No.: US 6,945,745 B2
(45) Date of Patent: Sep. 20, 2005

(54) INDUSTRIAL TRUCK WITH A DEVICE FOR MOVING A LIFTING FRAME

(75) Inventor: Oliver Retzlaff, Kusterdingen (DE)

(73) Assignee: Still Wagner GmbH & Co. KG (DE)

( * ) Notice: Subject to any disclaimer, the term of this patent is extended or adjusted under 35 U.S.C. 154(b) by 0 days.

(21) Appl. No.: 10/427,644

(22) Filed: May 1, 2003

(65) Prior Publication Data

US 2003/0206793 A1 Nov. 6, 2003

(30) Foreign Application Priority Data

May 2, 2002 (DE) ..... 102 19 739

(51) Int. Cl.[7] ..... B66F 9/00

(52) U.S. Cl. ..... 414/636; 414/661; 187/238; 187/226

(58) Field of Search ..... 187/238, 226, 187/233, 661; 414/661, 629, 636, 226

(56) References Cited

U.S. PATENT DOCUMENTS 4,365,921 A * 12/1982 Brouwer et al. ..... 414/347
4,538,954 A * 9/1985 Luebke ..... 414/633
4,580,650 A * 4/1986 Matsuda ..... 180/89.1
5,217,342 A * 6/1993 Grether ..... 414/635
5,244,336 A * 9/1993 Engler et al. ..... 414/642
5,697,755 A * 12/1997 McCauley et al. ..... 414/634
6,027,303 A * 2/2000 Voegeli ..... 414/673

* cited by examiner

*Primary Examiner*—Eileen D. Lillis
*Assistant Examiner*—Rashmi Sharma
(74) *Attorney, Agent, or Firm*—The Webb Law Firm

(57) ABSTRACT

An industrial truck has a chassis (1), a lifting frame (5), a load holding device (10) that can move vertically along the lifting frame (5), and at least one movement device to move the lifting frame (5) relative to the chassis (1). The acceleration and/or the speed of movement of the lifting frame (5) that can be achieved by the movement device can be controlled as a function of at least one operating parameter of the industrial truck. The operating parameter is measured at least approximately continuously. One operating parameter is the current lifting height of the load holding device (10). An additional operating parameter is the weight of a load that is being held by the load holding device (10).

9 Claims, 1 Drawing Sheet

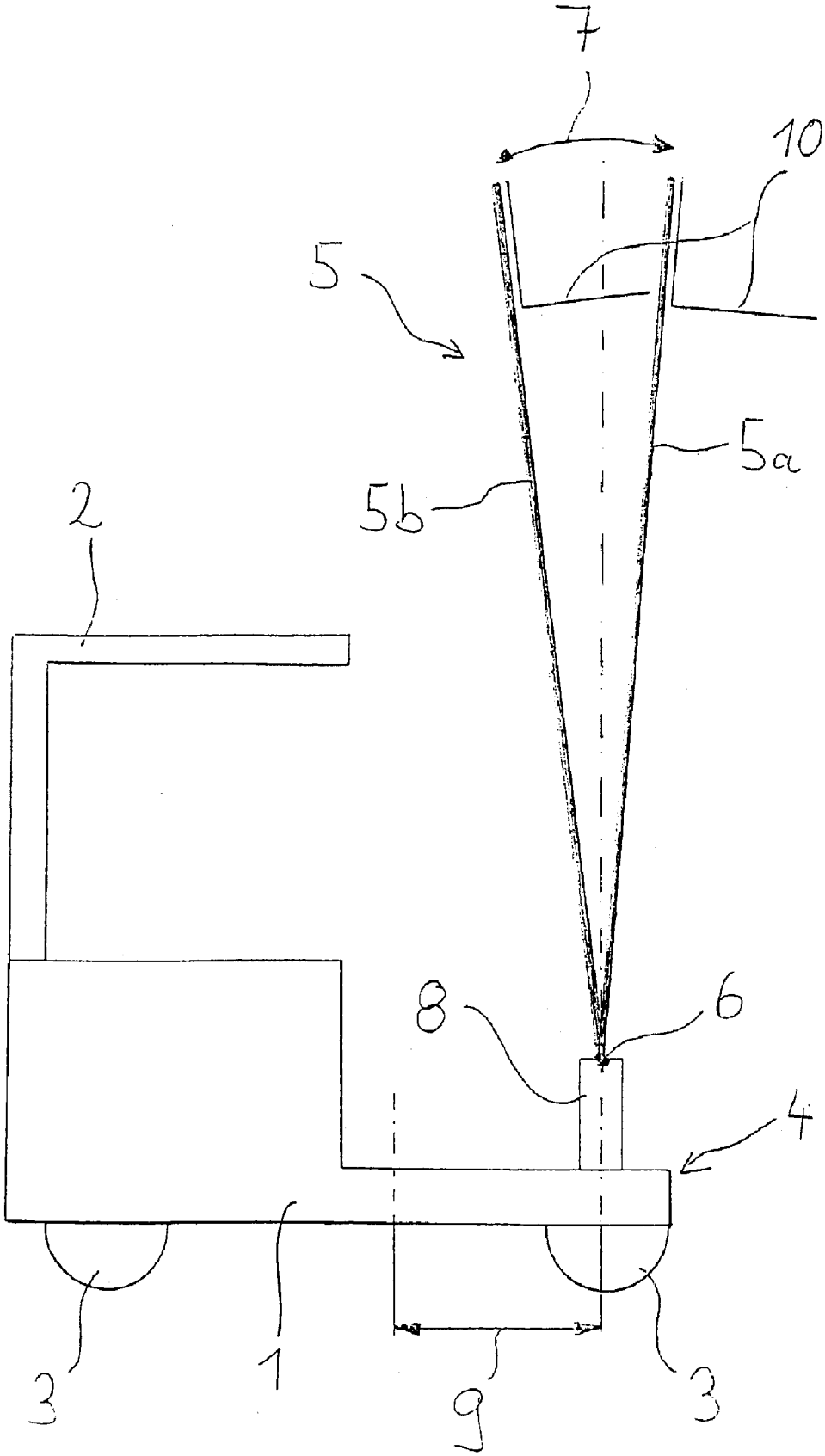
7
10
5
5a
5b
2
8
6
4
3
1
9
3

INDUSTRIAL TRUCK WITH A DEVICE FOR MOVING A LIFTING FRAME

CROSS-REFERENCE TO RELATED APPLICATION

This application corresponds to German Application No. 102 19 739.3, filed May 2, 2002, which is herein incorporated by reference.

BACKGROUND OF THE INVENTION

1. Field of the Invention

This invention relates to an industrial truck having a chassis, a lifting frame, load holding means that can move vertically along the lifting frame, and at least one movement device to move the lifting frame relative to the chassis.

2. Technical Considerations

Industrial trucks of the general type described above can be, for example, in the form of counterweighted fork-lift trucks or reach fork-lift trucks. Normally on these trucks, the lifting frame can be tilted relative to a chassis of the industrial truck by means of a tilting device. Reach fork-lift trucks also have a pushing device, by means of which the lifting frame can be displaced horizontally in the longitudinal direction of the industrial truck relative to the chassis.

Movement of the lifting frame with the tilting device or with the pushing device can result in vibration of the lifting frame, particularly when the load holding means are carrying a load and are significantly elevated. Vibration of this type should be prevented whenever possible because it can lead to instability of the load that is being carried and to an incorrect positioning of the load holding means. For this reason, the speed of the movement that can be generated by the movement device on industrial trucks of the prior art is set to a constant low level. As a result of which, vibration of the loaded and extended lifting frame can be limited to an acceptable degree. When the load holding means are lowered and unloaded, the same low value is used for the speed of the movement that can be generated with the movement device, even though there is no longer any danger of vibration of the lifting platform. Consequently, the cargo turnaround time of the industrial truck is reduced beyond the degree that is strictly necessary.

Therefore, it is an object of the invention to provide an industrial truck of the general type described above but with an improved cargo turnaround time.

SUMMARY OF THE INVENTION

The invention teaches that the acceleration and/or the speed of movement of the lifting frame that can be generated by means of the movement device can be controlled as a function of at least one operating parameter of the industrial truck. The operating parameter can be measured with an appropriate measurement instrument and can be converted into an electrical signal. An electronic control system processes the operating parameters and from them generates an actuating variable that governs the speed and/or acceleration of the load holding means. Possible actuating variables include, for example, the maximum speed or the maximum acceleration of the lifting frame that can be generated with the movement device. The term "acceleration" as used herein also includes a braking acceleration that can occur during the deceleration of the lifting frame.

It is particularly advantageous if the operating parameters can be measured at least approximately continuously or progressively, i.e., not in discrete intervals. The continuous measurement of the operating parameter(s) also makes it possible to vary the acceleration and/or the speed of the movement device, likewise approximately continuously, and to constantly adapt it to current conditions. For this application to be considered continuous, for example, the parameters can also be measured by means of an incremental measurement transducer.

An operating parameter is formed by the current lifting height of the load holding means. In this case, a two-channel lifting height sensor can be used which supplies a redundant signal. This system ensures that the calculation of the speed and/or the acceleration of the lifting frame is in no case based on an incorrect lifting height signal.

The maximum acceleration and/or the maximum speed of the movement of the lifting frame that can be achieved by means of the movement device can be influenced or controlled as a function of the lifting height, e.g., for a (first) lower lifting height a greater acceleration or a higher speed is possible than with a (second) higher lifting height.

A second operating parameter is formed by the weight of the load that is being held by the load holding means. The weight of the load can be determined indirectly, for example, by means of the pressure that occurs in a hydraulic lifting cylinder. The forces that act on the lifting frame during an acceleration of the load holding means are a direct function of the weight of the load.

The maximum acceleration and/or the maximum speed of the movement of the lifting frame that can be produced by means of the movement device can be influenced or controlled as a function of the weight of the load, e.g., when the weight is lower a greater acceleration or a higher speed is possible than when the weight is higher.

It is particularly advantageous if the movement device is formed by a tilting device for the lifting frame. When the lifting frame is lowered and unloaded, it can, therefore, be tilted more rapidly than when it is raised and loaded.

It is, likewise, advantageous if a movement device is formed by a pushing device for the horizontal displacement of the lifting frame. The displacement of the lifting frame relative to the chassis of the industrial truck is faster, the farther the load holding means are lowered, and the less the lifting frame is loaded.

The invention can be used to particular advantage if the industrial truck is a reach fork-lift truck. On a reach fork-lift truck, both the tilting device and the pushing device can be influenced or controlled as a function of one or more of the above-mentioned operating parameters. Compared to reach fork-lift trucks of the prior art, the invention achieves a particularly large decrease in the cargo turnaround time.

BRIEF DESCRIPTION OF THE DRAWING

Additional advantages and details of the invention are explained in greater detail below with reference to the exemplary embodiment that is illustrated in the accompanying schematic drawing.

The drawing FIGURE shows a fork-lift truck incorporating features of the invention.

DESCRIPTION OF THE PREFERRED EMBODIMENT

The drawing shows an exemplary industrial truck of the invention in the form of a reach fork-lift truck. The reach fork-lift truck has, as its principal components, a chassis 1 and a driver's cab cover 2, under which the driver's seat for the reach fork-lift truck is located. Wheels 3 are fastened to the chassis 1 in the area underneath the driver's seat and to wheel arms 4. The wheel arms 4 are also a component of the chassis 1. A telescoping lifting frame 5 can be tilted relative to the chassis 1 around a horizontal axis 6. The lifting frame 5 is shown in its forwardly tilted limit position 5*a* and in its backwardly tilted limit position 5*b*. The tilting angle 7 of the lifting frame 5 is normally approximately 6 degrees. Load holding means 10, e.g., in the form of a load fork, can be moved along the lifting frame 5. The lifting frame 5 that can be tilted around the axis 6 is mounted on a carriage 8. The carriage 8 is guided on the wheel arms 4 so that it can move in the horizontal direction. The figure shows the carriage 8 in its forward limit position, and it can be moved along the path 9 toward the driver's seat.

The pushing device to displace the carriage 8 and, thus, the lifting frame 5, along the path 9 can be driven by means of a hydraulic cylinder. The same method can be used to drive the tilting device to tilt the lifting frame 5 around the axis 6, which also can comprise at least one hydraulic cylinder. The hydraulic cylinders can be connected with a hydraulic pump by means of hydraulic valves. The accelerations and speeds of the tilting movement and the pushing movement can be determined by a corresponding setting of the hydraulic valves. It is also possible to control the accelerations and speeds of the above-mentioned movements by means of the speed of an electric motor that drives the hydraulic pump, and thereby supplying the motor with the appropriate current.

The invention teaches that the lifting height and the weight of a load that is on the load holding means 10 can be measured continuously by means of suitable conventional measurement transducers. This information is processed in an electronic control device of the industrial truck, whereby limit values can be determined for the speeds and accelerations of the pushing movement of the carriage 8 and of the tilting movement of the lifting frame 5. These limit values can be defined so that an excessive vibration of the lifting frame 5 is prevented. At the same time, however, the accelerations and speeds are not limited beyond the necessary extent, so that the reach truck achieves an optimal cargo turnover time. In the electronic control devices, the relationships between the measured variables determined and the allowable accelerations and speeds can be stored as software, for example, in the form of algorithms or characteristics. The control device can also be connected with the control levers which are activated by the driver for the tilting device and the pushing device. The hydraulic valves and the electric motor that drives the hydraulic pumps can be actuated directly or indirectly by the electronic control device on the basis of the control lever positions, whereby the accelerations and speeds are limited to the determined maximum values.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An industrial truck, comprising:

a chassis;

a lifting frame;

load holding means movable along the lifting frame; and at least one movement device to move the lifting frame relative to the chassis, wherein at least one of the acceleration and the speed of movement of the lifting frame that can be generated by the movement device is controlled as a function of at least one operating parameter of the industrial truck, wherein the operating parameter comprises the current lifting height of the load holding means, and wherein at least one of the maximum acceleration and the maximum speed of movement of the lifting frame that can be produced by the movement device can be controlled as a function of the lifting height so that at a first lifting height it, a greater acceleration or higher speed is possible than with a second lifting height that is higher than the first lifting height.

2. The industrial truck as claimed in claim 1, wherein the movement device includes a tilting device for the lifting frame.

3. The industrial truck as claimed in claim 1, wherein the movement device includes a pushing device for the horizontal displacement of the lifting frame.

4. The industrial truck as claimed in claim 3, wherein the industrial truck is a reach truck.

5. An industrial truck, comprising:

a chassis;

a lifting frame;

load holding means movable along the lifting frame; and at least one movement device to move the lifting frame relative to the chassis, wherein at least one of the acceleration and the speed of movement of the lifting frame that can be generated by the movement device is controlled as a function of at least one operating parameter of the industrial truck, wherein the operating parameter comprises the weight of the load being carried by the load holding means, and wherein at least one of the maximum acceleration and the maximum speed of the movement of the lifting frame that can be produced by the device can be controlled as a function of the weight of the load such that at a first weight, a greater acceleration or a higher speed is possible than at a second weight that is higher than the first weight.

6. The industrial truck as claim 5, wherein the industrial truck is a reach truck.

7. The industrial truck as claimed in claim 5, wherein the movement device includes a pushing device for the horizontal displacement of the lifting frame.

8. The industrial truck as claimed in claim 5, wherein the movement device includes a tilting device for the lifting frame.

9. An industrial truck, comprising:

a chassis;

a lifting frame;

load holding means movable along the lifting frame; and at least one movement device to move the lifting frame relative to the chassis, wherein at least one of the acceleration and the speed of movement of the lifting frame that can be generated by the movement device is controlled as a function of at least one operating parameter of the industrial truck, wherein the at least one operating parameter is measure approximately continuously, wherein the operating parameter comprises the current lifting height of the load holding means, and wherein at least one of the maximum acceleration and the maximum speed of the movement of the lifting fame that can be produced by the movement device can be controlled as a function of the lifting height so that at a first lifting height, a greater acceleration or higher speed is possible than with a second lifting height that is higher than the first lifting height.

* * * * *

UNITED STATES PATENT AND TRADEMARK OFFICE

CERTIFICATE OF CORRECTION

PATENT NO. : 6,945,745 B2
DATED : September 20, 2005
INVENTOR(S) : Oliver Retzlaff It is certified that error appears in the above-identified patent and that said Letters Patent is hereby corrected as shown below:

Column 4,
Line 30, “height it, a greater” should read -- height, a greater --.
Line 58, “by the device” should read -- by the movement device --.
Line 63, “as claim 5” should read -- as claimed in claim 5 --.

Column 6,
Line 1, “parameter is measure” should read -- parameter is measured --.

Signed and Sealed this

Twenty-first Day of March, 2006

JON W. DUDAS
*Director of the United States Patent and Trademark Office*